US006305435B1

(12) United States Patent
Meier et al.

(10) Patent No.: US 6,305,435 B1
(45) Date of Patent: Oct. 23, 2001

(54) WEAVING MACHINE WITH AN INSERTION SYSTEM FOR A PLURALITY OF GENERALLY DIFFERENT WEFT THREADS

(75) Inventors: Karl Meier; Dietmar Markward, both of Rüti (CH)

(73) Assignee: Sulzer Textil AG, Joweid Zentrum (CH)

( * ) Notice: Subject to any disclaimer, the term of this patent is extended or adjusted under 35 U.S.C. 154(b) by 0 days.

(21) Appl. No.: 09/664,934

(22) Filed: Sep. 19, 2000

(30) Foreign Application Priority Data

Sep. 23, 1999 (EP) ..... 810853

(51) Int. Cl.[7] ..... D03D 47/34; D03D 47/38
(52) U.S. Cl. ..... 139/453; 139/194
(58) Field of Search ..... 139/453, 194

(56) References Cited

U.S. PATENT DOCUMENTS 3,340,903 * 9/1967 Golobart ..... 139/194
3,926,224 * 12/1975 Vermeulen et al. ..... 139/453
4,513,792 * 4/1985 Lincke ..... 139/453
5,186,218 * 2/1993 Riesen ..... 139/453
6,112,776 * 9/2000 Berktold ..... 139/453

FOREIGN PATENT DOCUMENTS

0357975A2 3/1990 (EP) .
0461524A1 12/1991 (EP) .
0796936A2 9/1997 (EP) .
0816545A1 1/1998 (EP) .
2177725A 1/1987 (GB) .

* cited by examiner

*Primary Examiner*—Andy Falik
(74) *Attorney, Agent, or Firm*—Townsend and Townsend and Crew LLP

(57) ABSTRACT

The weaving machine contains an insertion system for a plurality of generally different weft threads, which comprises for each weft thread a thread supply (2), a thread store (3) and a color selector (4) for the selective serving of the weft threads as well as a rapier (10) for inserting the served weft thread. At least one common thread brake (7) is provided for all weft threads (1) in order to brake the respective served weft thread (1) during the insertion as required. In addition to the simple mechanical construction, the simple handling and controlling are seen as advantageous.

10 Claims, 3 Drawing Sheets

WEAVING MACHINE WITH AN INSERTION SYSTEM FOR A PLURALITY OF GENERALLY DIFFERENT WEFT THREADS

The invention relates to a weaving machine with an insertion system for a plurality of generally different weft threads in accordance with the preamble of claim 1.

Systems for inserting a plurality of weft threads are known which comprise, for each weft thread, at least a thread supply, a thread store with a brake which is integrated on the thread draw-off side e.g. in the form of a brush ring, a thread monitor, a thread brake, and a thread server as a part of a color selector as well as a rapier. The weft threads travel from the thread supply via the thread store, the thread monitor, the thread brake and the thread server either into the cloth in which the weft thread is bound in or into a thread clamp in which the weft thread is held. For the insertion of a weft thread the latter is displaced by the thread server into the path of movement of the rapier and taken up by the rapier. The bound in weft thread is severed and is inserted into the opened shed. The clamped weft thread is inserted and beaten up and severed beyond the clamping position.

It proves disadvantageous in this insertion system that a thread monitor and at least one thread brake are provided for each weft thread in which the drawn in weft thread always remains. The thread brake becomes contaminated with the abraded material, so that the thread brake must be periodically cleaned in order to avoid thread breakages.

The object of the invention is to create a weaving machine with a simplified and reliably operating insertion system.

This object is satisfied in accordance with the invention by the characterizing features of claim 1.

In the insertion system with a thread supply, a thread store, a color selector and a rapier the weft threads travel, starting from the thread supply, via the thread store and the thread server of the color selector into the cloth. In this the otherwise usual thread guidance between the thread store and the color selector is dispensed with, so that only one friction point is present, which is formed by the thread server. The color selector serves, by means of a respective thread server, a weft thread to the rapier, which takes over the weft thread and inserts it into the open shed. Only one thread brake is provided in order to brake the respectively served weft thread. Since each weft thread is drawn into the thread brake, the thread brake cleans itself.

The invention will be explained in the following with reference to the accompanying drawings, which are explanations in schematic illustration.

Figures 1, 2:
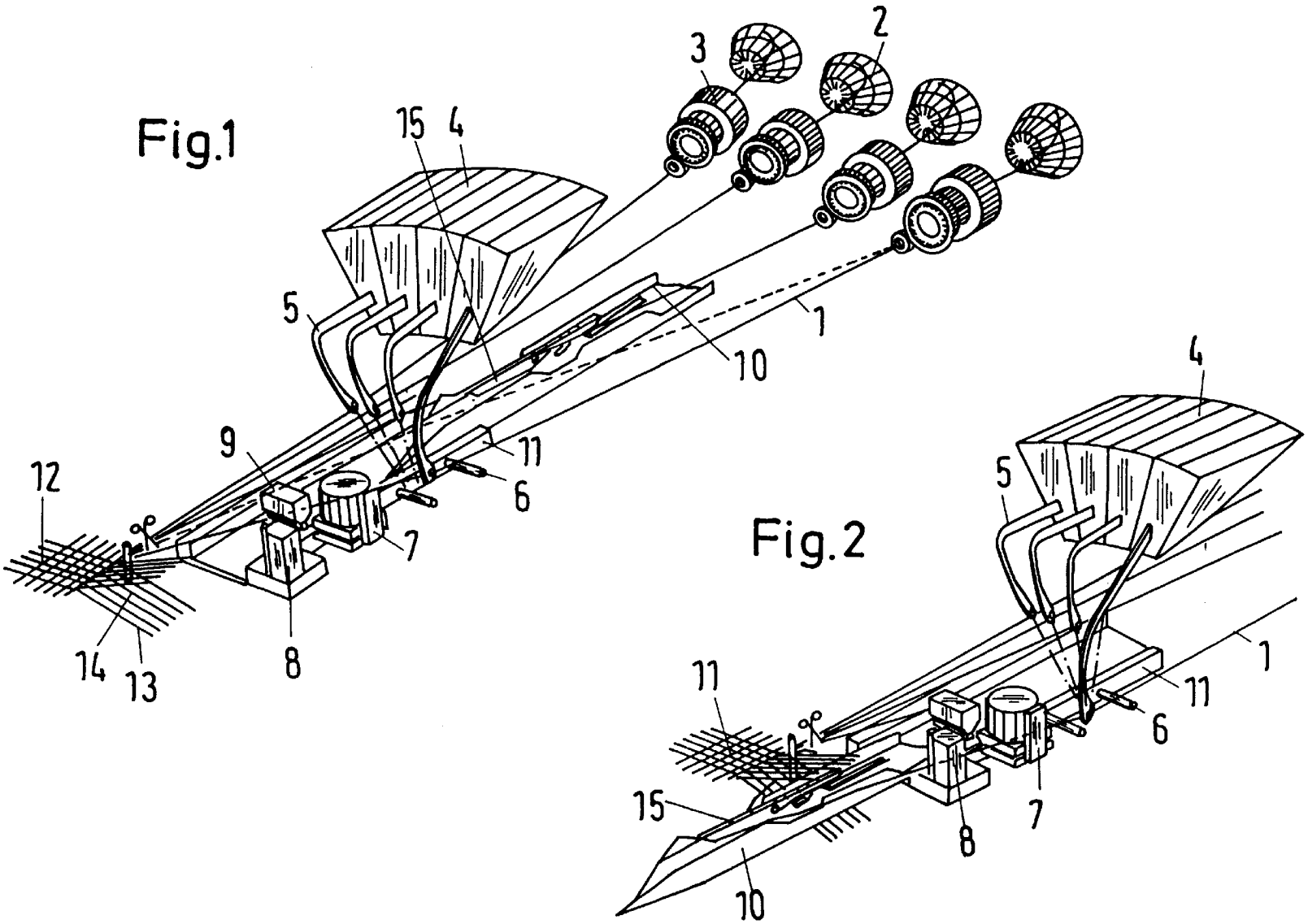
Figure 4:
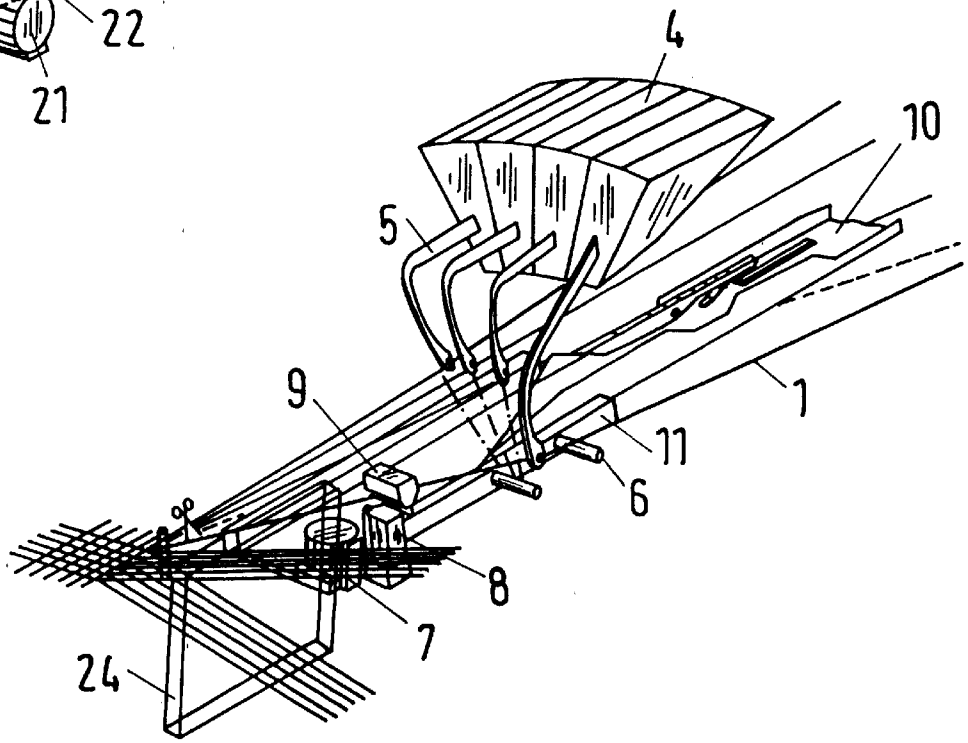
Figure 3:
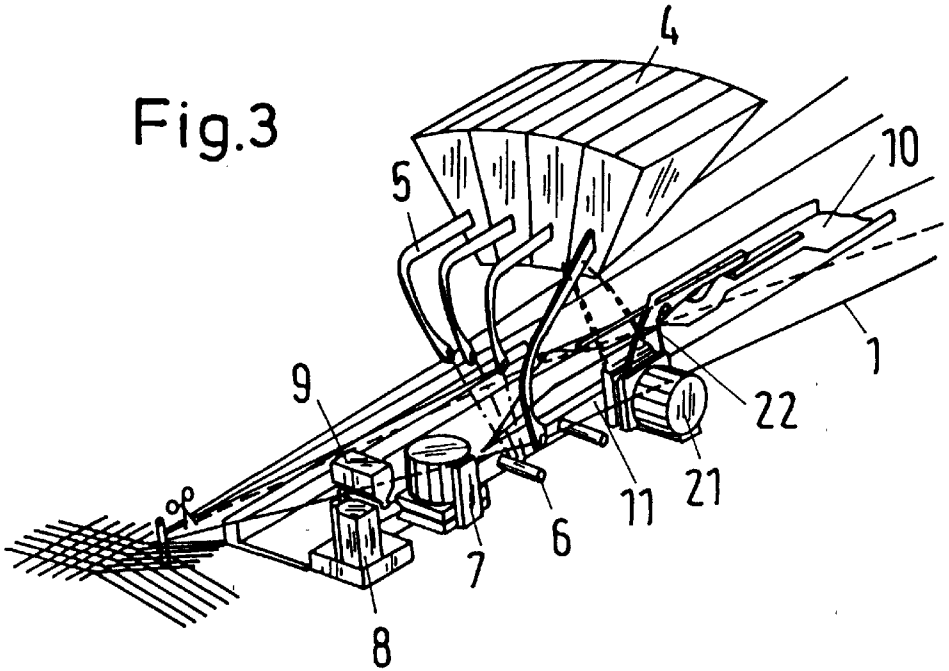
Figure 5:
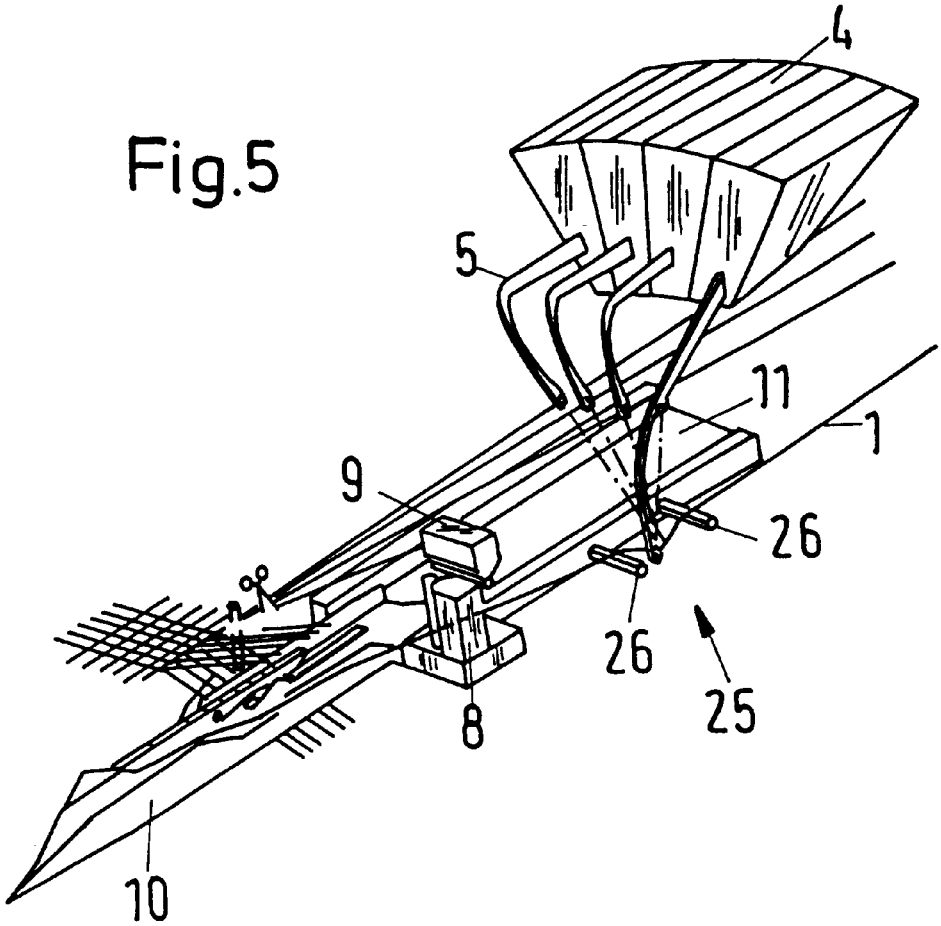
Figure 6:
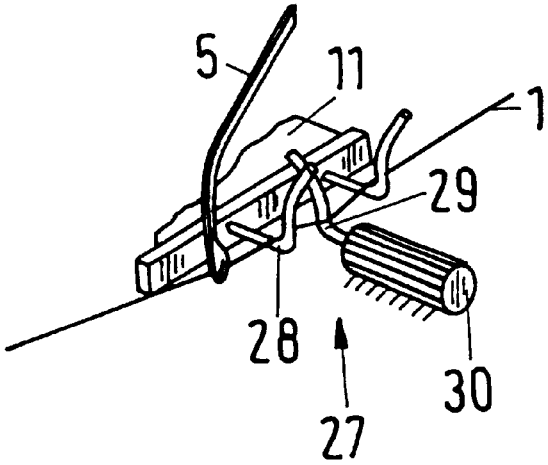

Shown are:

FIG. 1 a first embodiment of an insertion system in accordance with the invention;

FIG. 2 the insertion system in accordance with FIG. 1 during the insertion;

FIG. 3 a second embodiment of the insertion system in accordance with the invention;

FIG. 4 a third embodiment of the insertion system in accordance with the invention;

FIG. 5 a fourth embodiment of the insertion system in accordance with the invention and FIG. 6 a modified embodiment of a thread brake.

Reference is made to FIGS. 1 and 2. The figures show an embodiment of an insertion system by means of which, e.g., four weft threads with, e.g., different color and/or thickness and/or structure are inserted. The insertion system contains for each weft thread 1 a supply bobbin 2, a thread store 3 with a brake integrated on the thread draw-off side, e.g. in the form of a brush ring, and a color selector 4 with four thread servers 5. The insertion system also contains, for all four weft threads jointly, guide members 6 for calming or steadying the served thread which are arranged in the range of action of the thread server 5, as well as a thread brake 7, a sensor 8, by means of which the thread tension is measured and the weft thread to be inserted is monitored and a thread monitor 9 for detecting an unintentional double weft, which are arranged in the travel direction of the thread following the color selector 4, as well as a rapier 10. The supply bobbins 2, the thread stores 3 and the color selector 4 are arranged in a known manner at the weaving machine. The guide members 6, the thread brake 7, the sensor 8 and the thread monitor 9 are arranged at a guiding part 11 for the rapier. The guide members 6 are executed as pins. The thread servers 5, the thread brake 7, the sensor 8 and the thread monitor 9 are connected in a signal transmitting manner to a control system (not illustrated) of the weaving machine in order to control the insertion.

At the beginning of the insertion the weft threads 1 are in a holding position (FIG. 1), with the latter extending via the color selector 4 into the cloth 11 starting from the thread store 3 and being kept outside the path of travel of the rapier. For the insertion the corresponding color selector 4 will displace the weft thread to be inserted into the shed out of the holding position and into a transfer position as a result of a control command. In this transfer position the weft thread 1 crosses the path of travel of the rapier. At the same time the weft thread is laid in contact at the guiding members 6 in order to steady the weft thread. During the movement into the shed 14, which is formed by the warp threads 12, the rapier takes up the served weft thread with its thread clamp 15. In this way the weft thread, which is tied off in the cloth, is introduced into the clamping gap of the thread clamp so that the weft thread is held in the thread clamp (FIG. 2). In the further course of the movement of the rapier the weft thread is, on the one hand, sensed by means of the thread monitor 9 and, on the other hand, the weft thread is drawn in into the braking gap of the thread brake 7. Then the weft thread is severed in the region of the cloth edge by means of a severing apparatus. Finally the weft thread is brought into contact with the sensor 8 in order to measure the behavior of the thread tension during the insertion of the weft thread and, where appropriate, to vary it in the same cycle or in a subsequent insertion cycle in accordance with requirements and to monitor the weft thread in order, for example, to detect a thread breakage and in order to emit a weaving machine stop signal.

The embodiment shown in FIG. 3 differs from the embodiment in accordance with FIG. 1 in that, in addition to the first thread brake 7, a second thread brake 21 is provided, in order, e.g., to increase the braking action. This thread brake is provided with guide bows 22 in order to introduce the weft thread to be served into the thread brake 21 reliably. It is pointed out that the second thread brake can also be provided alone.

FIG. 4 shows a third embodiment of an insertion system. This embodiment differs from those in accordance with FIGS. 1 and 2 in that the thread brake 7 is arranged at the sley. The advantage of this solution consists in the fact that the action of the thread brake is maintained until the time point of the reed beat up.

FIG. 5 shows an embodiment with a looping or wrapping-type friction brake. This thread brake 25 is formed by two braking pins 26 and the respective thread server 5 which serves a selected weft thread. This embodiment represents the simplest solution by means of which the braking function can also be carried out in addition to the serving function. In this the amount of the looping and thus the braking action becomes controllable via the size of the depth of movement of the thread server in relation to the braking pins.

FIG. 6 shows a modified embodiment of the thread brake in accordance with FIG. 5. The thread brake 27 contains two stationary bows or hooks 28 which are mounted at a distance from one another at the guiding part 11 for the rapier and a linearly movable bow or hook 29 which is connected to a setting motor 30 and which is adjustable relative to the stationary bows 28. It is self evident that a plurality of stationary as well as movable bows can be provided, with e.g. the advantage of a reduced stroke.

In the above described embodiments different embodiments of thread brakes, e.g. those with automatic setting of the braking force or those with a braking force regulation, which are operated electrically, pneumatically or in another suitable form, can in general be used.

The weaving machine contains an insertion system for a plurality of generally different weft threads, which comprises for each weft thread a thread supply 2, a thread store 3 and a color selector 4 for the selective serving of the weft threads, as well as a rapier 10 for inserting the served weft thread. At least one common thread brake 7 is provided for all weft threads 1 in order to brake the respectively served weft thread 1 during the insertion in accordance with requirements.

In addition to the simple mechanical construction, the simple handling and controlling are seen as advantageous.

What is claimed is:

1. A weaving machine comprising an insertion system for a plurality of different weft threads, the insertion system comprising, for each weft thread, a thread supply, a thread store and a color selector for selective serving of the weft threads, the weaving machine further comprising a rapier for inserting a served weft thread, a first common thread brake for all weft threads in order to brake a respective served weft thread during insertion, and a second thread brake in order to achieve an increased braking action.

2. A weaving machine in accordance with claim 1 wherein the first thread brake is arranged at a rapier guiding part that is provided for the rapier.

3. A weaving machine in accordance with claim 1 wherein the first thread brake is arranged between the thread store and the color selector.

4. A weaving machine in accordance with claim 1 wherein the first thread brake is arranged at a reed.

5. A weaving machine in accordance with claim 1 further comprising guide members for the served weft thread.

6. A weaving machine in accordance with claim 1 further comprising guide bows for the first thread brake in order to guide the served weft thread.

7. A weaving machine in accordance with claim 1 further comprising a sensor for at least one of monitoring and measuring thread tension of the weft thread to be inserted, the sensor being arranged at a stationary weaving machine part.

8. A weaving machine in accordance with claim 7 wherein the sensor is arranged at a rapier guide part provided for the rapier.

9. A weaving machine in accordance with claim 1 further comprising a thread monitor for detecting an unintentional double insertion.

10. A weaving machine in accordance with claim 1 wherein the first thread brake is a looping brake that is formed by two stationary braking members and the respective thread server that serves a weft thread, wherein the braking action is determined by the size of the movement of the thread server.

* * * * *